US006216910B1

(12) United States Patent
Numerick

(10) Patent No.: US 6,216,910 B1
(45) Date of Patent: Apr. 17, 2001

(54) AUTOMATIC ARTICLE DISPENSER

(76) Inventor: Allen Numerick, 5261 Harvard, Detroit, MI (US) 48224

( * ) Notice: Subject to any disclaimer, the term of this patent is extended or adjusted under 35 U.S.C. 154(b) by 0 days.

(21) Appl. No.: 09/301,235

(22) Filed: Apr. 28, 1999

(51) Int. Cl.[7] ..... G07F 11/00
(52) U.S. Cl. ..... 221/7; 221/82
(58) Field of Search ..... 221/2, 3, 4, 7, 221/15, 9, 82, 86, 79, 121, 132

(56) References Cited

U.S. PATENT DOCUMENTS

| | | | |
|---|---|---|---|
| 3,722,739 | | 3/1973 | Blumberg . |
| 4,207,992 | | 6/1980 | Brown . |
| 4,573,606 | | 3/1986 | Lewis et al. . |
| 4,674,651 | | 6/1987 | Scidmore et al. . |
| 4,747,514 | | 5/1988 | Stone . |
| 4,838,453 | | 6/1989 | Luckstead . |
| 4,872,591 | | 10/1989 | Konopka . |
| 5,044,516 | | 9/1991 | Hoar . |
| 5,152,422 | | 10/1992 | Springer . |
| 5,154,296 | | 10/1992 | Cutler . |
| 5,176,285 | | 1/1993 | Shaw . |
| 5,200,891 | | 4/1993 | Kehr et al. . |
| 5,221,024 | | 6/1993 | Campbell . |
| 5,246,136 | | 9/1993 | Loidl . |
| 5,392,952 | | 2/1995 | Bowden . |
| 5,472,113 | | 12/1995 | Shaw . |
| 5,522,525 | * | 6/1996 | McLaughlin et al. ..... 221/4 |
| 5,564,593 | | 10/1996 | East, Sr. . |
| 5,575,392 | | 11/1996 | Cutler . |
| 5,646,912 | | 7/1997 | Cousin . |
| 5,657,236 | | 8/1997 | Conkright . |

* cited by examiner

*Primary Examiner*—Kenneth W. Noland
(74) *Attorney, Agent, or Firm*—Fildes & Outland, P.C.

(57) ABSTRACT

An article dispenser for individually dispensing a plurality of articles on a timed basis. A plurality of modules, each containing a magazine having a plurality of circumferentially spaced, open top and bottom ended article storage compartments and a rotatable disk having an aperture successively alignable with each storage compartment in the magazine, are vertically stacked in a column. A drive motor and timing dial rotates the disks through interlocking timed lugs mounted on each disk in a staggered, angular offset, timed relationship in which the apertures in each disk are angularly offset through the stack so that the articles in the storage compartments are successively transferred through the storage compartments of each successive module to the next lower module and from the lowermost module to a circular track disposed below the lowermost module. A paddle rotates about the track at a predetermined time interval to transfer the articles to an interior holding chamber from which the articles are retrieved when a door is opened or, if not timely retrieved, are transferred from the article holding chamber to a storage container. Sensors detect the presence of articles in the non-retrieved article storage container, and in an interior holding chamber between the lowermost module and the discharge chute and activate indicators and/or lights.

22 Claims, 10 Drawing Sheets

AUTOMATIC ARTICLE DISPENSER

BACKGROUND OF THE INVENTION

1. Field of the Invention

This invention relates, in general, to article dispensers and, specifically, to article dispensers for dispensing articles, such as pills, vitamins and the like, on a time basis at predetermined intervals.

2. State of the Art

Medication, such as pills, vitamins, and the like, is usually taken on a time basis, that is, one or more pills are taken every prescribed time interval, such as every two hours, throughout the day and/or night. Such medications when administered at home are done by the user himself.

Failure to take the specified dosage of medication at the required time intervals greatly diminishes the effectiveness of the medication. Conversely, taking more than the specified dosage at more frequent than prescribed intervals can also lead to undesirable health effects.

This problem is exaggerated when one or more different medications must be taken at different time intervals throughout the day and/or night. Individuals who are elderly or chronically ill frequently do not have sufficient mental capabilities to keep track of the different frequencies and dosages of the medications they are required to take over a sustained period of time. Since such people may be left alone for extended periods of time, a caretaker frequently does not know whether the proper amount and the type of medication was taken at the prescribed time intervals.

HIV and AIDS patients have complicated medication regimens which often involve taking 30 or more pills or capsules daily. Although such individuals do not have diminished mental capabilities, the daily, repetitious regimen of pill selection becomes a burden that frequently results in non-compliance which reduces the effectiveness of the potent drug "cocktails".

Various devices have been developed to address these problems by properly dispensing the required dosage of medications, such as pills, vitamins, and the like, at the prescribed time intervals. One simple device makes use of a conventional mechanical timer to remind the user that it is time to take a particular medication. More complex devices provide the automatic dispensing of one or more medications at a plurality of different time intervals throughout the day and/or night. Such devices typically include a rotatable disk containing a plurality of spaced, individual compartments. Means are provided for successively opening each compartment or for discharging the contents of each compartment on a time basis at prescribed intervals.

Most of the automatic, time-based article dispensers, particularly those designed for dispensing medications such as pills, vitamins, and the like, have a limited amount of storage space, typically covering only one day or one day and night. If such devices are designed to dispense medications over a longer time period, i.e., one week, then the number of separate time intervals at which such medications may be dispensed during each 24-hour time period is reduced to a smaller number, such as four intervals in each 24-hour period.

U.S. Pat. No. 4,747,514 discloses an automatic medication dispenser containing a plurality of vertically stacked cylinders, each containing a plurality of spaced, individual compartments. Each cylinder is successively engaged from top to bottom in the stack by a drive means to bring successive compartments in each cylinder in line with a chute formed by aligned openings in the cylinders which extend from the top of the stack of cylinders to a lower disposed discharge tray. Thus, the medications, such as the pills, vitamins, etc., in the upper cylinder or cylinders, fall through the chute from the top to the bottom of the stack to reach the discharge tray. Since some pills and vitamins are fragile, such movement and abrupt impact on the discharge tray can cause breakage of such medications, making them difficult to take and interrupting the time dispensing of proper dosages of such medications.

U.S. Pat. No. 5,522,524 discloses a medication dispenser station which has a plurality of medication-containing cassettes arranged in a vertical stack. The cassettes have aligned discharge openings defining an open discharge chute. The discharge openings in each vertically stacked cassette are alignable with similar openings in adjacent, vertically spaced cassettes to enable a pill from one of the cassettes to fall through the aligned discharge opening of all of the lower cassettes to the article receiver. As in previously described pill dispensers, this length of travel can be considerable and can lead to breakage of the individual pills.

U.S. Pat. No. 5,564,593 discloses a similar apparatus for dispensing medication which includes a plurality of dose modules rotatably mounted in a vertical stack within a housing. Each disk has a plurality of apertures which are sealed on either side with a pierceable film. A microprocessor activates a dose signal means indicating that a dose of prescribed medication should be dispensed from the device. Manual intervention on the part of an operator is required to actuate an extractor which pierces the film and releases the dose lot contained therein.

It would be desirable to provide an automatic time-based article dispenser, particularly suited for dispensing medications, which overcomes the disadvantages of previously devised automatic article dispensers. It would also be desirable to provide an automatic time-based article dispenser which has extensive article storage for dispensing articles at prescribed time intervals over a long period of time. It would also be desirable to provide an automatic time-based article dispenser which is designed to minimize breakage of the articles during the dispensing of such articles. Finally, it would be desirable to provide an automatic, time-based article dispenser which is easy to load or refill.

SUMMARY OF THE INVENTION

The present invention is an automatic time-based article dispenser which dispenses articles, such as medications including pills, vitamins, and the like, at prescribed intervals over a long period of time.

The article dispenser comprises a plurality of modules which are vertically stacked in a co-axial column. Each module includes an article container magazine having a plurality of article-containing compartments. Each of the compartments has an open top and an open bottom. A disk is rotatably mounted in each magazine and has an aperture successively alignable with each compartment in the magazine as the disk rotates about a central axis through the module. Means are provided for rotating the disks in each of the modules in a timed relationship with each other to successively align the aperture in each disk with successive compartments in the associated magazine to transfer articles from successive compartments in each magazine to corresponding compartments in the immediate lower magazine from the top to the bottom of the stack. A discharge chute is disposed below the lowermost magazine. A means for moving articles from the lowermost magazine to the discharge chute is provided to transfer articles to the discharge chute on a timed basis.

In a preferred embodiment, the rotating means includes a first drive means, such as an electric motor. Means are provided for coupling the drive means, such as through the output shaft of the motor, to the lowermost disk. Timing lug means are mounted on each disk in each module and disposed at predetermined, initial angular positions about the central axis of the module stack for engaging the timing lug means of adjacent disks to cause a staggered, time-delayed advance and offset of the apertures in each disk as the drive means rotates the lowermost disk. This causes the articles to drop only from one disk to the next lower adjacent disk and not through the entire vertical stack of disks as in previously devised automatic article dispensers, such as that shown in U.S. Pat. No. 4,747,514. This minimizes any potential breakage of such articles, particularly fragile pills and capsules.

The successive moving means also includes a second drive means, such as an electric motor, which is coupled to a paddle for rotating the paddle one revolution about a track located below the lowermost module to collect articles dropped from the compartments of the lowermost magazine and to transfer all collected articles to a temporary interior holding chamber communicatable with the discharge chute.

The second drive means is activated once every predetermined amount of incremental rotation of the first drive means. In a preferred embodiment, the second drive means is activated once for each incremental advance of the aperture in the lowermost disk to the next storage compartment in the lowermost magazine. The activating means preferably comprises spaced flanges mounted on a timing dial engaging the lugs on the disk of the lowermost magazine. In one aspect, a gap between two adjacent flanges is detected by a photo detector which generates an output signal activating the second drive means at the prescribed time.

In another aspect of the present invention, the article dispenser is provided with article removing means which is associated with the discharge chute. The article removing means removes any dispensed articles not retrieved via the discharge chute prohibiting an accumulation of articles in the discharge chute and preventing the user from taking an overdose of such dispensed articles in the case of medications.

Preferably, the article removing means comprises a door pivotal with an outer flap disposed over the discharge chute and forming the temporary interior holding chamber in combination with a paddle below a discontinuity in the track. A removable compartment is mounted in the article dispenser in communication with the interior holding chamber and the paddle to transfer any dispensed, but not retrieved articles in the interior holding chamber to the storage chamber before any new articles are dispensed to the chamber.

Each magazine is preferably provided with an outwardly extending key. The keys on each of the magazines have incrementally increasing lengths to form a stepped arrangement from the bottom to the top of the vertical stack of modules. An outer shell partially surrounds the vertical stack of the modules. A stepped wall is formed in the rear wall of the housing and includes a plurality of keyed steps which mate with the keys on the modules to matingly receive the keys only in a predetermined vertical stack order.

Sensor means may be mounted in the storage chamber for sensing the presence of articles in the storage chamber. The sensor means may be connected to an alarm, such as a visual or audible alarm, or a remote automatic telephone dialer to provide an indication that articles dispensed by the article dispenser have not been timely removed from the discharge tray within a prescribed amount of time after dispensing.

The automatic article dispenser of the present invention provides dispensing of articles at prescribed intervals over a predetermined lengthy time period. One or more articles may be stored in each storage compartment in the article dispenser for added versatility and use of the article dispenser of the present invention.

The article dispenser contains a large number of individual storage compartments for dispensing articles, such as medications, over a long period of time, such as each day for one week. Further, each individual module contains a large number of individual storage compartments for dispensing articles within a selected period of the total time period, such as every two hours in a 24-hour day.

The article dispenser of the present invention uniquely prevents any potential breakage of the stored articles, particularly pills, capsules, and the like, since such articles are transferred from the storage compartment in each vertical stacked module only one module at a time and not through the entire vertical stack of modules at one time as in previously devised article dispensers. Finally, the article dispenser of the present invention is easy to load or refill with additional articles and is constructed so that the individual article containing modules may be arranged only in a prescribed time dispensing order.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
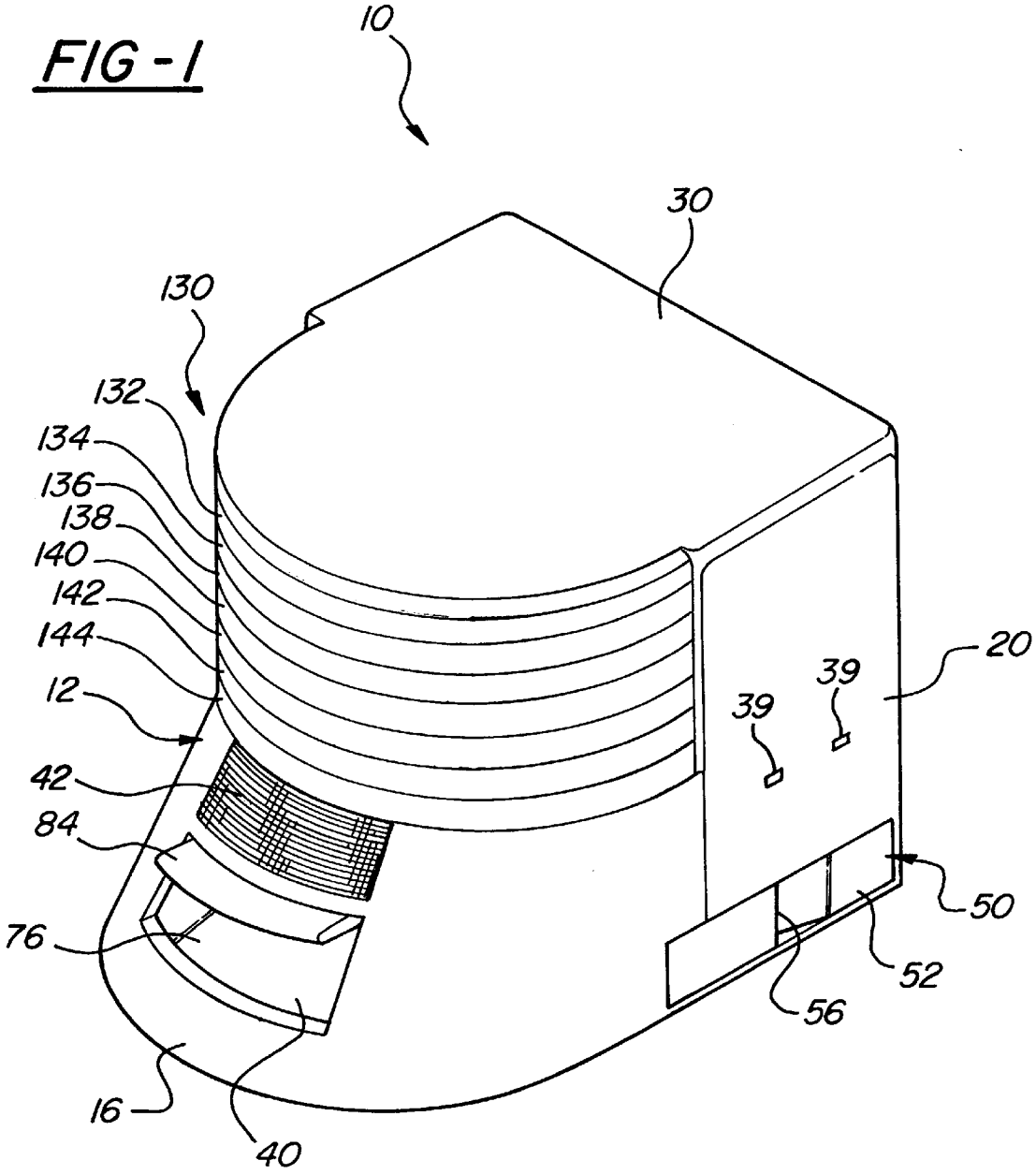
FIG. 1 is a perspective view of an assembled article dispenser according to the present invention.

Throughout the following description and drawing, an identical reference number is used to refer to the same component shown in multiple figures of the drawing.

Referring now to the drawing, and to FIG. 1 in particular, there is illustrated an automatic time-based article dispenser 10 which is particularly suited for dispensing articles, such as medications and vitamins including pills, capsules and the like, at prescribed intervals over a predetermined total time period. Although the following description and illustration of the article dispenser of the present invention describes its usage in dispensing medications and vitamins, such as pills, capsules and the like, it will be understood that the article dispenser of the present invention may be employed in any diverse application, besides dispensing medications, which can advantageously use the automatic, timed dispensing of articles.

Figure 2:
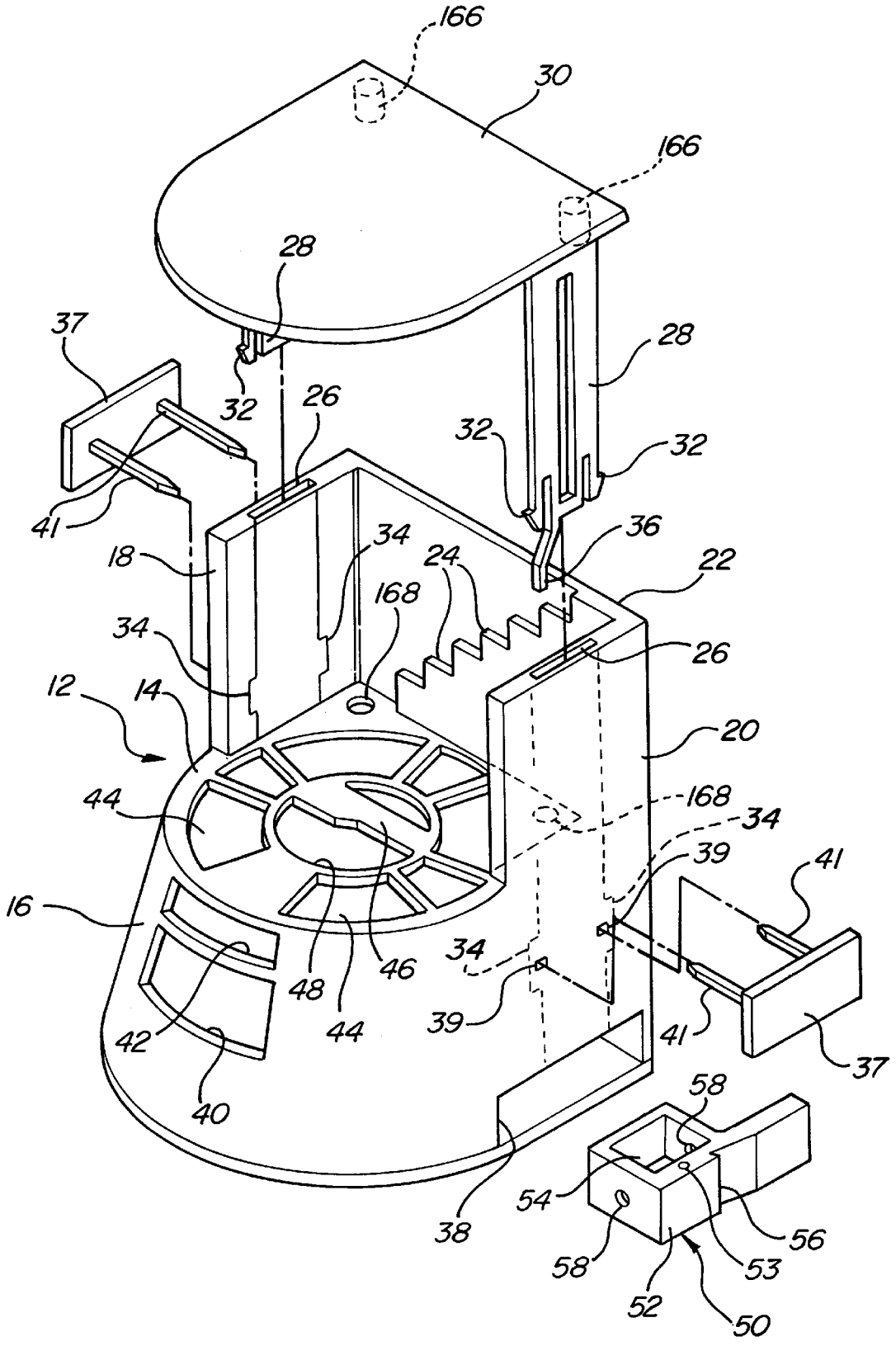
FIG. 2 is an exploded, perspective view of the article dispenser shown in FIG. 1.
Figure 3:
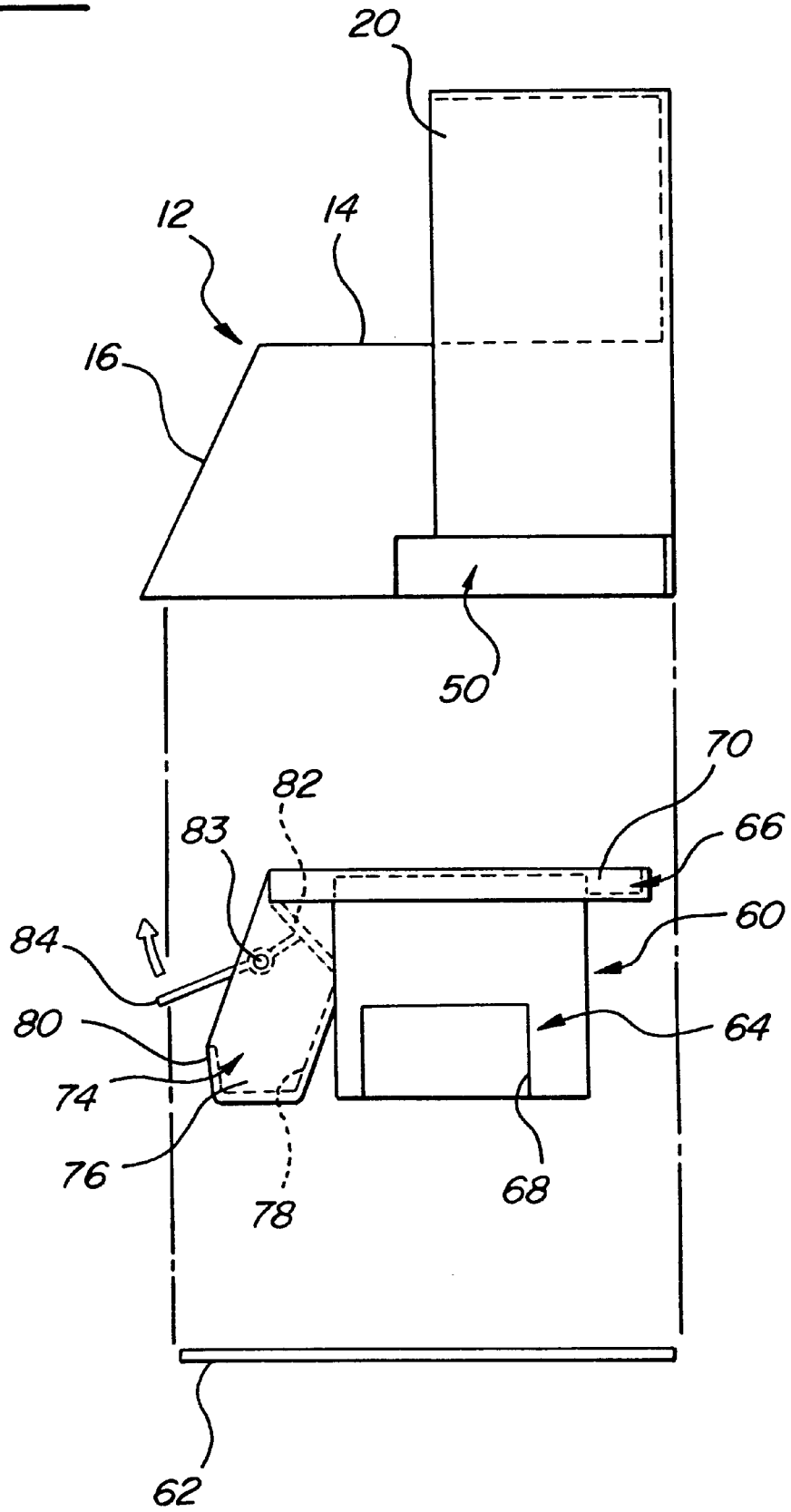
FIG. 3 is an exploded, side elevational view of the article dispenser shown in FIGS. 1 and 2.

Referring now to FIGS. 1–3, the article dispenser 10 includes an outer shell 12 having an intermediate, generally horizontally extending base 14, a smoothly curved front wall 16 depending from the base 14, a pair of vertically extending, opposed sidewalls 18 and 20 and a rear wall 22. The sidewalls 18 and 20 and the rear wall 22 have end portions which extend vertically upward from the base 14.

A plurality of keyed steps, all denoted generally by reference number 24 project outward from the inner surface of the rear wall 22. The steps 24, as described in greater detail hereafter, provide keyed mounting of the individual article modules in a vertical stack to ensure proper positioning of each module.

Slots 26 are formed from the upper edge of each of the sidewalls 18 and 20 for receiving legs 28 which depend from a cover 30. The cover 30 is sized to overlay and cover the upper surfaces of the sidewalls 18 and 20, the rear wall 22 and substantially all of the upper surface of the vertical stack of modules as shown in FIG. 1.

Latch projections 32 are formed on a lower portion of each opposed side of each leg 28 for engaging internal notches 34 formed within grooves on the inner surface of the sidewalls 18 and 20 to releasably latch the cover 30 to the sidewalls 18 and 20.

Apertures 39 are formed through the sidewalls 18 and 20 of the outer shell 12 and are alignable with the notches 34. The apertures 39 receive projections 41 on a key 37 which, when inserted through the apertures 39, forces the latch projections 32 on the leg 28 of the cover 30 out of engagement with the notches 34 enabling the cover 30 to be moved upward under the bias of a spring arm 36. It should be understood that although a single key 37 may be employed to unlatch the cover 30 from the outer shell 12 through one sidewall of the outer shell 12, two keys 37 requiring near simultaneous unlatching of both legs 28 of the cover 30 may also be employed.

A spring arm 36 having a resiliently bent outer end extends downward from a lower end of at least one and preferably both of the legs 28 on the cover 30. The distal or freely movable end of the spring arm 36 is bendable inward as the leg 28 of the cover 30 slides through the grooves 26 in the sidewalls 18 and 20 of the outer shell 12.

When the cover 30 is fully inserted into the slots 26 latching the latch projections 32 in the notches 34 in the sidewalls 18 and 20 of the outer shell 12, the distal end of the spring arm 36 will be biased inward to generate an upward biasing force on the legs 28. When the latch projections 32 are released by means of the key 37, as described above, the spring force stored in the spring arm 36 will cause the legs 28 of the cover 30 to slide upward in the slots 26 thereby enabling the entire cover 30 to be separated from the outer shell 12.

A pair of slot-shaped apertures 40 and 42 are formed in the front wall 16. The aperture 40 is designed for receiving the dispensing chute and flap, as described hereafter. The aperture 42 is designed to receive a transparent or colored cover plate for use as an article dispensing indicator, as also described hereafter.

In addition, a plurality of circumferentially spaced apertures 44 are formed in the base 14 and alignable with the storage compartments in the modules. A cross bar 46 extends diametrically across a central aperture 48 in the base 14. The cross bar 46 acts as a mounting surface for one drive motor mounted in an inner shell.

A non-retrieved article storage container 50 having an outer face 52 and an internal compartment or cavity 54 is slidably insertable through the aperture 38 in the sidewall 20 until the outer face 52 is flush with the sidewall 20. A finger engagement edge 56 is formed in the outer face 52 to enable a user to withdraw the storage container 50 from the outer shell 12 as well to reinsert the storage container 50 into the interior of the outer shell 12. As described hereafter, the internal compartment 54 in the storage container 50 is positioned when the storage container 50 is mounted within the outer shell 12 to receive articles which have been positioned for dispensing from the dispenser 10, but which have not been timely withdrawn by a user. The use of the storage container 50 provides control over the non-retrieved articles dispensed by the article dispenser 10. This can be particularly important when the articles are various medications, such as vitamins, pills, etc. The compartment 54 is trough or V-shaped. Apertures 58 are formed on opposite sides of the storage container for forming a photo beam therethrough.

As shown pictorially in FIG. 2, the distal end of the spring arm 36 on one of the legs 28 of the cover 30, when the cover 30 is in the fully inserted position in the outer shell 12, extends into engagement with an aperture 53 formed on the top surface of the outer face 52 of the storage container 50 to lock the storage container 50 in the inserted position within the outer shell 12. The cover 30 must be released, as described above, from the fully latched position to enable the storage container 50 to be removed from the outer shell 12.

Figure 9:
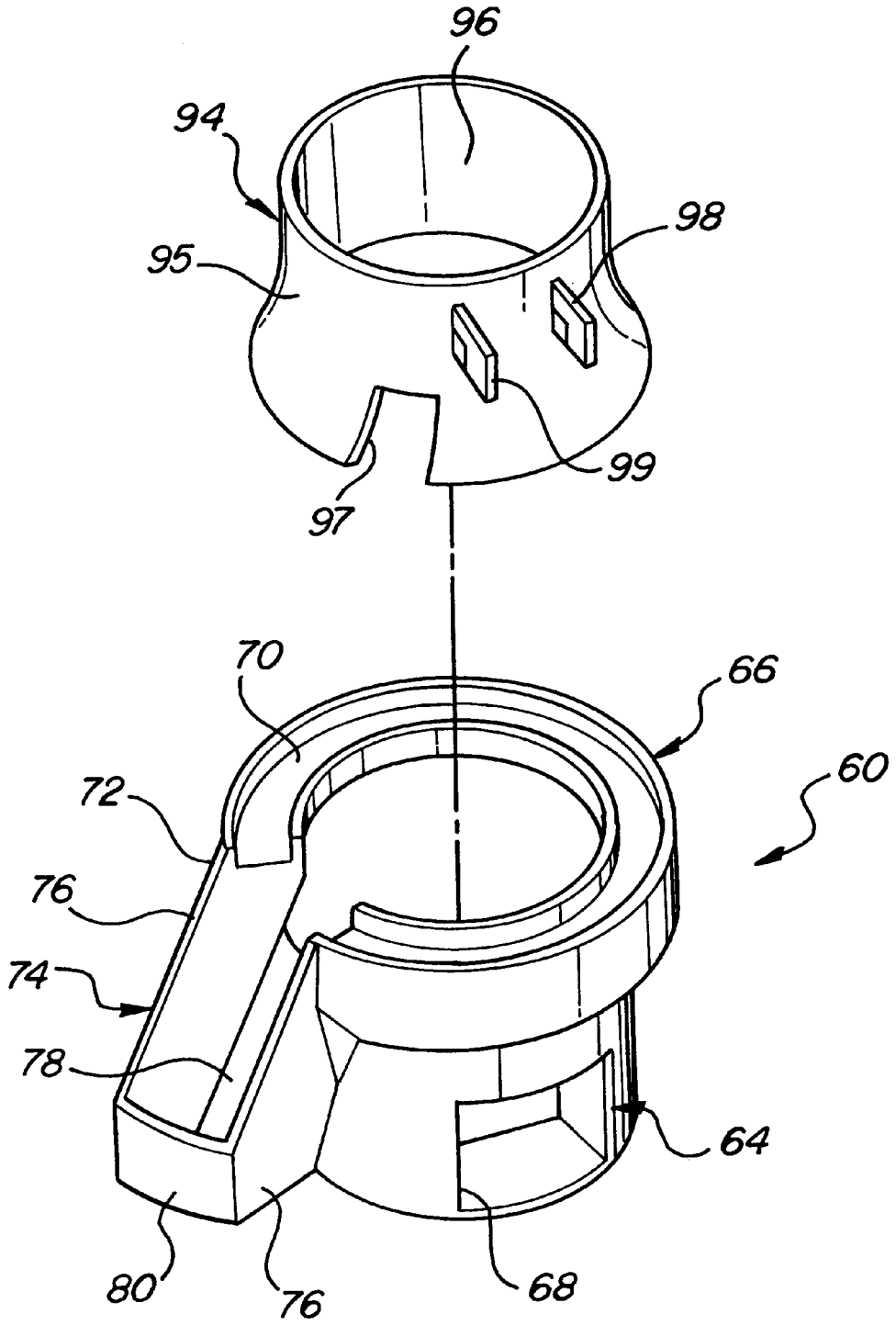
FIG. 9 is an exploded, perspective view of the inner shell and paddle assembly.

As shown in FIGS. 3, 9 and 10, an inner shell 60 seats on a bottom cover 62 which is secured by means of fasteners, adhesive, etc., to the lower edge of the outer shell 16. The inner shell 60 is in the form of a generally cylindrical body having a cylindrical base portion 64 and a radially enlarged upper portion 66. A cavity 68 is formed in the base portion 64 for receiving the storage container 50.

The upper portion 66 has an annular track 70 formed along an upper edge. A discontinuity or aperture 72 is formed in the track 70 over an angularly depending discharge chute 74. The discharge chute is formed of a pair of sidewalls 76 mounted on the inner shell 60, a bottom wall 78 and an outer end wall 80. When the inner shell 60 is mounted within the outer shell 12, the end wall 80 is positioned adjacent to a bottom forward portion of the front wall 16 of the outer shell 12. The interior cavity formed in the discharge chute 74 between the sidewalls 76, the bottom wall 78 and the end wall 80 opens to the aperture 40 in the front wall 16 of the outer shell 12 allowing access to articles contained within the bottom portion of the discharge chute 74.

Figure 10A:
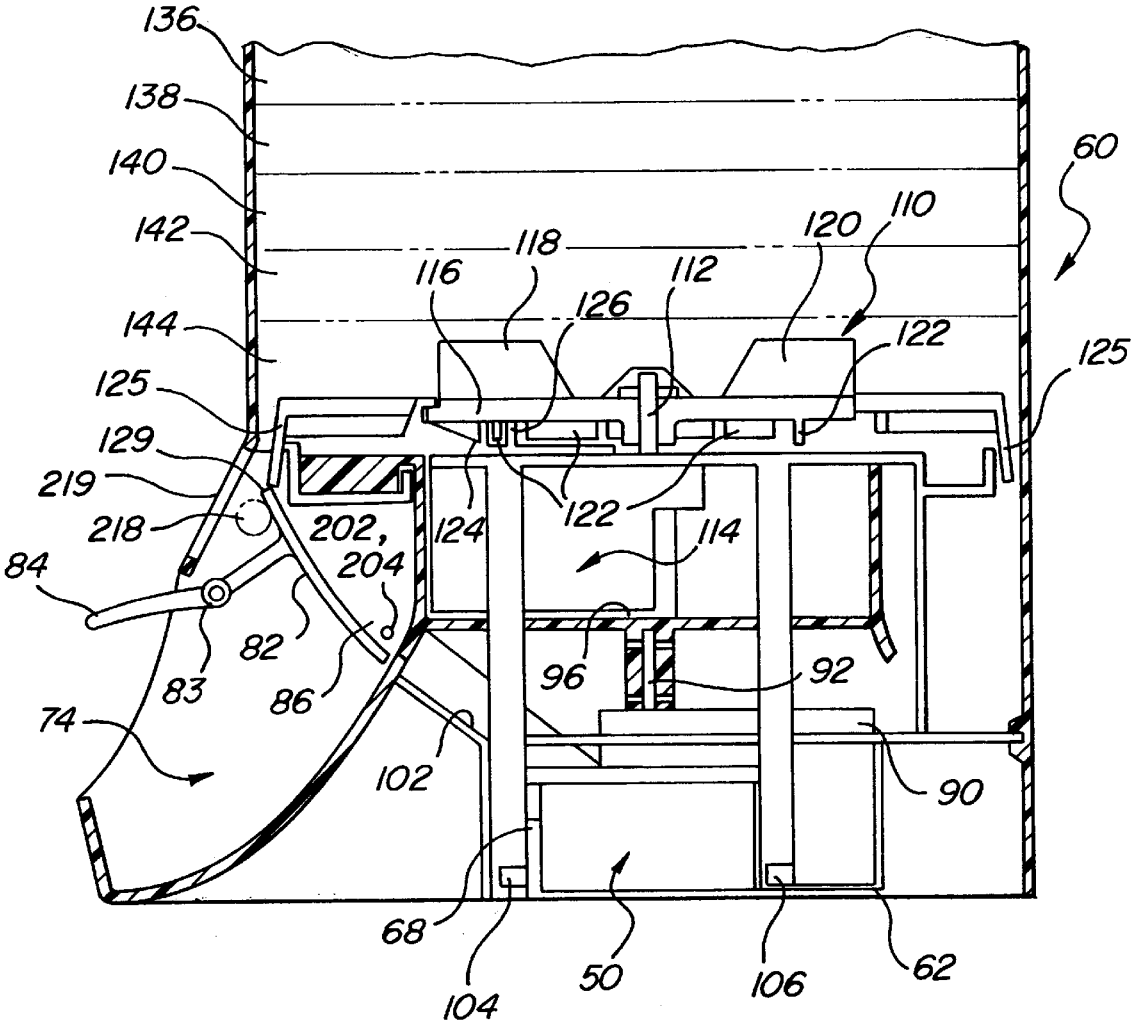
FIG. 10A is a side elevational view showing the drive means of the present article dispenser.
Figure 10B:
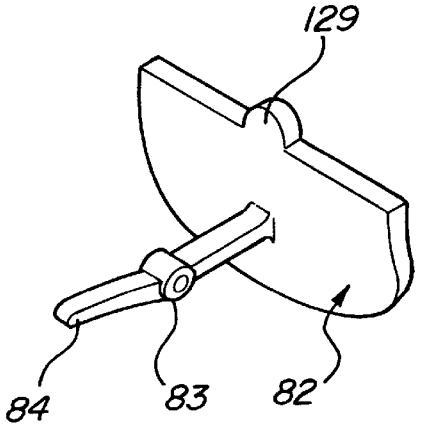
FIG. 10B is a perspective view of the drive means of the present article dispenser.

As shown in FIGS. 3 and 10A and 10B, a door 82 is pivotally mounted on a hinge pin 83 extending across the upper ends of the sidewalls 76 of the discharge chute 74. A flap 84 is unitary with the door 82 and projects angularly therefrom. The flap 84 extends through the aperture 40 in the front wall 16 when the inner shell 60 is mounted within the outer shell 12. However, the flap 84 is capable of upward, pivotal movement in the direction of the arrow in FIG. 3 allowing release of any articles in the temporary holding chamber 86 into the discharge chute 74.

In a nominal, closed position shown in FIG. 10A, the door 82 extends across the upper end of the discharge chute 74 and is positioned below the discontinuity or aperture 72 in the track 70. In this manner, any articles swept along the upper track 70 by a paddle assembly described hereafter fall through the discontinuity 72 into an interior holding chamber denoted by reference number 86 in FIG. 10 formed by the door 82, the upper portion of the sidewalls 76 of the discharge chute 74 and the flared lower paddle assembly 94. The chamber 86 acts as a temporary article holding chamber. Articles dispensed into the interior holding chamber 86, shown in FIG. 10A, will fall to the bottom of the interior chamber 86. When the flap 84 is pivoted upwardly by a user, the door 82 pivots in a clockwise direction, as shown by the arrow in FIG. 3, allowing any articles in the interior holding chamber 86 to fall into and down to the lower end of the discharge chute 74.

Articles dispensed from each of the modules in the stack 130, as described hereafter, will eventually fall from the lowermost module onto the upper track 70. A first drive means or electric motor 90, mounted within the inner shell 60, as shown in FIG. 10, has an outward extending output shaft 92. The shaft 92 engages a paddle assembly 94, shown in FIG. 9. The paddle assembly 94 is formed of a one-piece member having a cylindrical wall 95 with an interior rib structure 96 which engages the end of the motor output shaft 92 for simultaneous rotation with rotation of the output shaft 92 of the first motor 90. The lower end of the cylindrical wall 95 forms an outward flared portion. An aperture 97 is formed in the flared portion of the cylinder wall 95.

A pair of arms, including a pusher arm 98 and a blocker arm 99, project radially from the upper edge of the wall 95 of the paddle assembly 94. The arms 98 and 99 are positioned to fit within the upper track 70 and will normally be spaced on opposite sides of the discharge opening 72 in the track 70 and the aperture in the disk in the lowermost module, as described hereafter. In this manner, any articles dispensed from the lowermost module will fall onto the upper track 70 and be retained on the track 70 by the spaced arms 98 and 99.

The aperture 97 in the lower flared portion of the cylindrical wall 95 of the paddle assembly 94 is rotationally offset from the blocker arm 99 in the counter-clockwise direction of rotation of the paddle assembly 94. Thus, at a nominal stop position of the paddle assembly 94 wherein the pusher arm 98 and the blocker arm 99 straddle the discontinuity 72 in the track 70, the aperture 97 will be offset from the blocker arm 90 and not in communication with an inclined chute 102, shown in FIG. 10, which communicates with the portion of the inner shell 60 which receives the storage container 50. However, once the paddle assembly 94 begins its counter-clockwise rotation, the aperture 94 will quickly move into alignment with the inclined chute 102 and enable any non-retrieved articles remaining in the interior holding chamber 86 which were not retrieved by the user within the required time after initial discharge of the articles into the interior holding chamber 86, to fall through the aperture 96 and along the inclined chute 102 into the storage container 50.

During the remainder of the rotation of the paddle assembly 94, the lower end of the flared portion 96 of the paddle assembly 94 blocks access to the inclined chute 102 and actually forms a rear portion of the interior holding chamber 86.

As shown in FIG. 10, one or more article detectors, each in the form of a light source 104 and a photo receptive receiver 106, is mounted in the inner shell 60 on opposite sides of the storage container 50 when the storage container 50 is mounted in the inner shell 60. The light source 104 and photo receiver 106 are aligned with apertures 58 formed in a lower portion of the storage container 50. Any articles which are in the storage container 50, as described above, will break the light beam between the light source 104 and the receiver 106 causing the receiver to generate an output signal to activate an indicator light on the article dispenser 10 and/or a telephone auto-dialer indicating that articles which should have been retrieved after being dispensed were not timely removed by the user and are now in the storage container 50.

Figure 12:
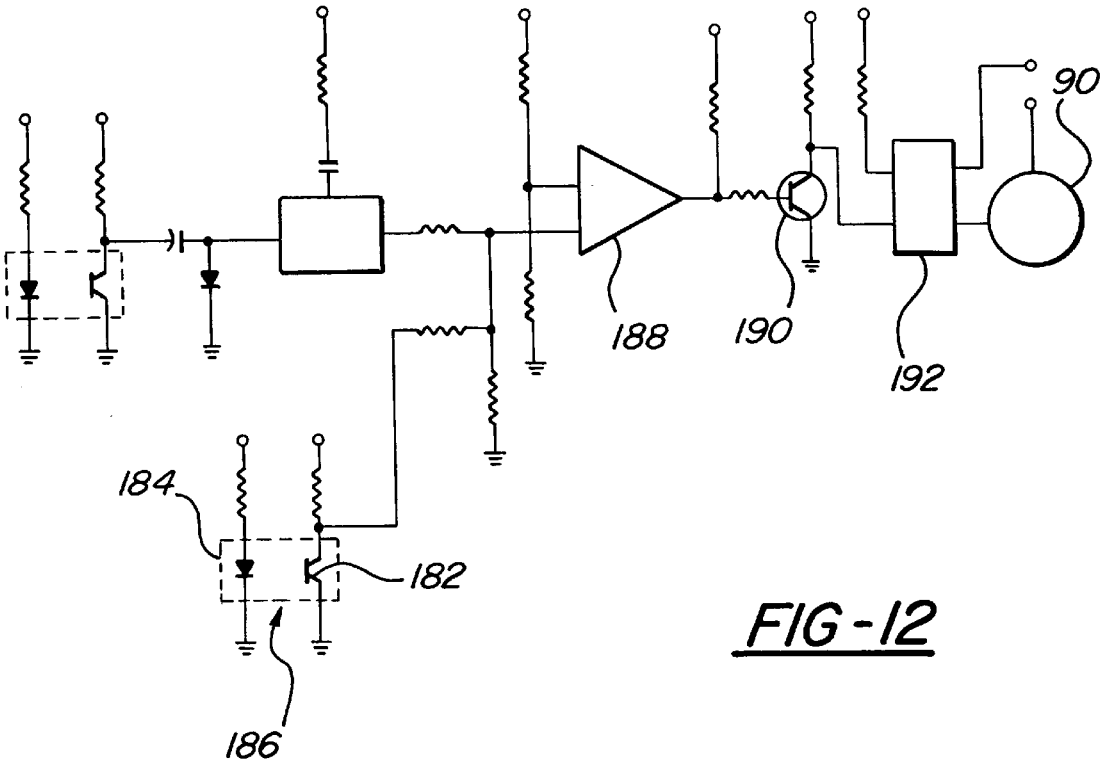
FIG. 12 is a schematic diagram of the dispenser motor control circuit of the present article dispenser.
Figure 15:
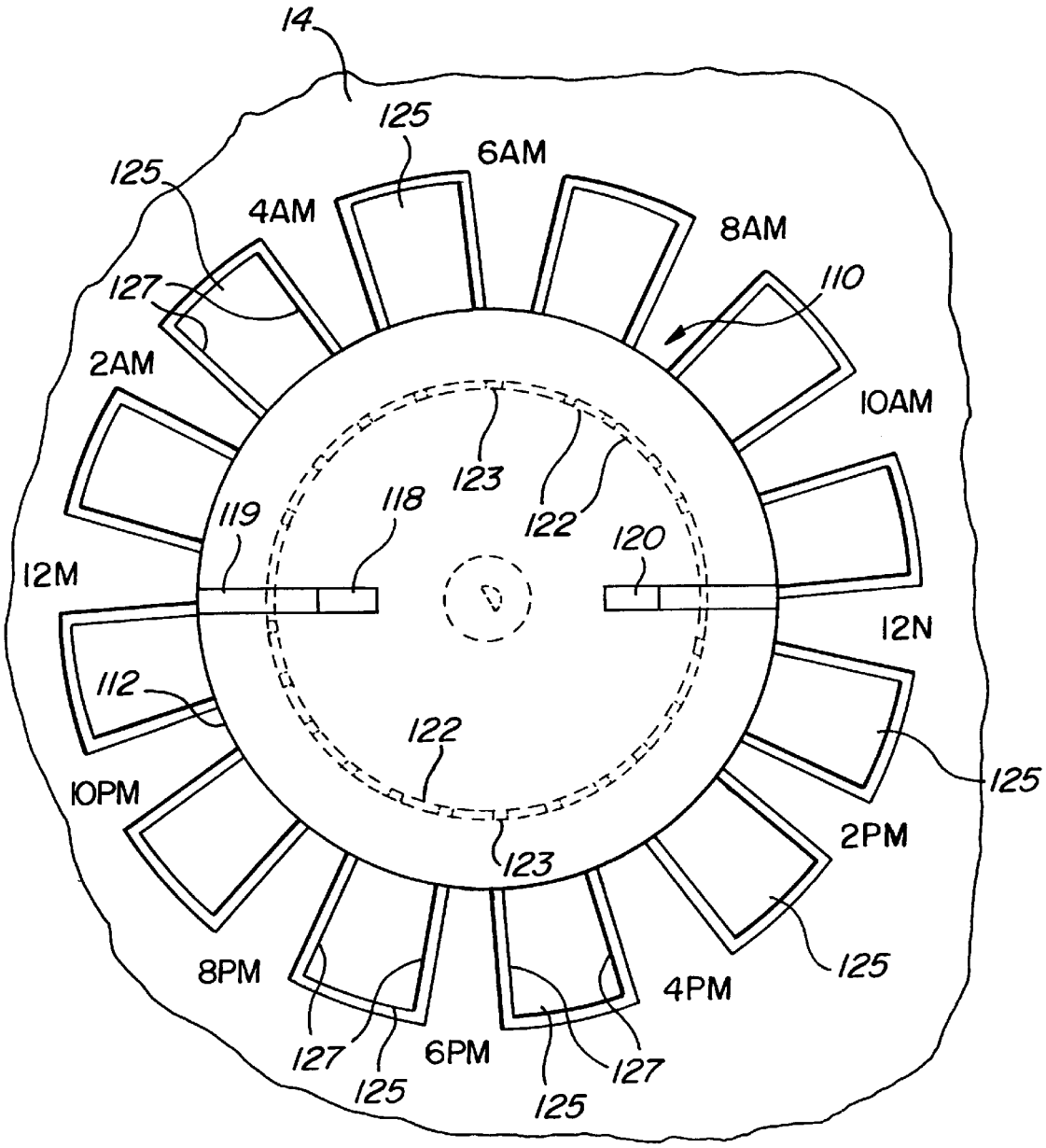
FIG. 15 is a plan view of the timer dial.

As shown in FIGS. 10, 12 and 15, a timer dial 110 is fixedly mounted on an output shaft 112 of a second electric motor 114. The second electric motor 114 is mounted by means of brackets, straps and fasteners to the cross bar 46 on the base 14 of the outer shell 12.

The timer dial 110 is in the form of a planar disk 116 which is keyed or otherwise fixedly secured to the output shaft 112 for simultaneous, unidirectional rotation with the output shaft 112 when the second electric motor 114 is energized. The timer dial 110 has a pair of upstanding tabs 118 and 120 which are diametrically opposed and project upwardly from the plane of the disk 116.

A plurality of arcuate, circumferentially arranged flanges 122 project downwardly from the underside of the disk 116. The flanges 122 are provided in a number corresponding to the number of dispensing periods in each module, such as 12 in the present example. Each adjacent two flanges 122 are each spaced apart by a gap or aperture 123 which can be read by an aligned pair 186 of a photo receiver and a light source which can be mounted on upwardly extending flanges 124 and 126 on the base 14 of the outer shell 12. Each signal from the photo receiver/light source pair 186 corresponds to the start of each discrete dispensing period.

Other types of incremental advance detectors, such as cams and a switch, etc., may also be employed to provide a signal for each dispensing period.

As shown in FIGS. 10 and 15, the article dispenser 10 is provided with a lock device for locking the door 82 in the first position preventing discharge of any articles dispensed from the interior holding chamber 86. The lock means comprises, by example only, a plurality of lock arms 125, which circumferentially project outward and downward from the periphery of the timer dial 110. One lock arm 125 is provided for each distinct article dispensing period. Thus, in the present example, 12 lock arms 125 are provided on the timer dial 110. The lock arms 125 are solid plates attached to the timer dial 110 by narrow tubular extensions 127 to form openings between adjacent lock arms 125 that permit articles to pass from the lowermost module 144 through the timer dial 110 to the track 70. The lock arms 125 may also be joined to one another at their top ends connected to the extensions 127 for added strength.

As also shown in FIG. 15, the lock arms 125 are angularly positioned relative to the gap 123 between each adjacent pair of flanges 122 on the timer dial 110 so as to provide a predetermined window or time period for the user to manually pivot the door 82 from the first position in which the door 82 forms a part of the closed interior holding chamber 86 to the second open position allowing articles in the interior holding chamber 86 to be discharged to the dispensing chute 74. By example, a 15 minute article retrieval window is employed in the present invention. Thus, the leading edge of each lock arm 125, as viewed in a counterclockwise rotating direction of movement of the timer dial 110, is angularly spaced clockwise from the rearmost edge of each gap 123 as formed by the leading edge of one flange 122. Other angular spacings to provide any desired time period in which the user can freely manipulate the door 82 may also be provided.

The upper portion of the door 82 is provided with a small protuberance or nub 129 which is narrower than the openings between the lock arms 125 and is engaged and blocked from movement by the lock arms 125 as each lock arm 125 rotates to an interference position with respect to the nub 129.

As shown in FIG. 10A, the lower edge of each lock arm 125, when the door 82 is pivoted to the first position, either contacts or is disposed in close proximity to the nub 129 on the door 82 to prevent any substantial upward pivotal movement of the door 82 which could cause articles in the interior holding chamber 86 to fall into the chute 74.

The article dispenser 10 includes a plurality of modules which are vertically arranged in a co-axially aligned column or stack 130. By way of example only, seven modules are illustrated in FIG. 1 for dispensing articles at prescribed intervals through each 24-hour time period or day over one entire week. It will be understood that the number of modules may be varied as well as the timed period of rotation of each module to provide different article dispensing time periods as well as a total, overall dispensing time period.

Thus, the article dispenser 10, in the illustrated example shown in FIG. 1, includes a topmost positioned module 132, a plurality of intermediate modules 134, 136, 138, 140 and 142 which are vertically and successively arranged below the topmost module 132, and a lowermost module 144.

Figure 4:
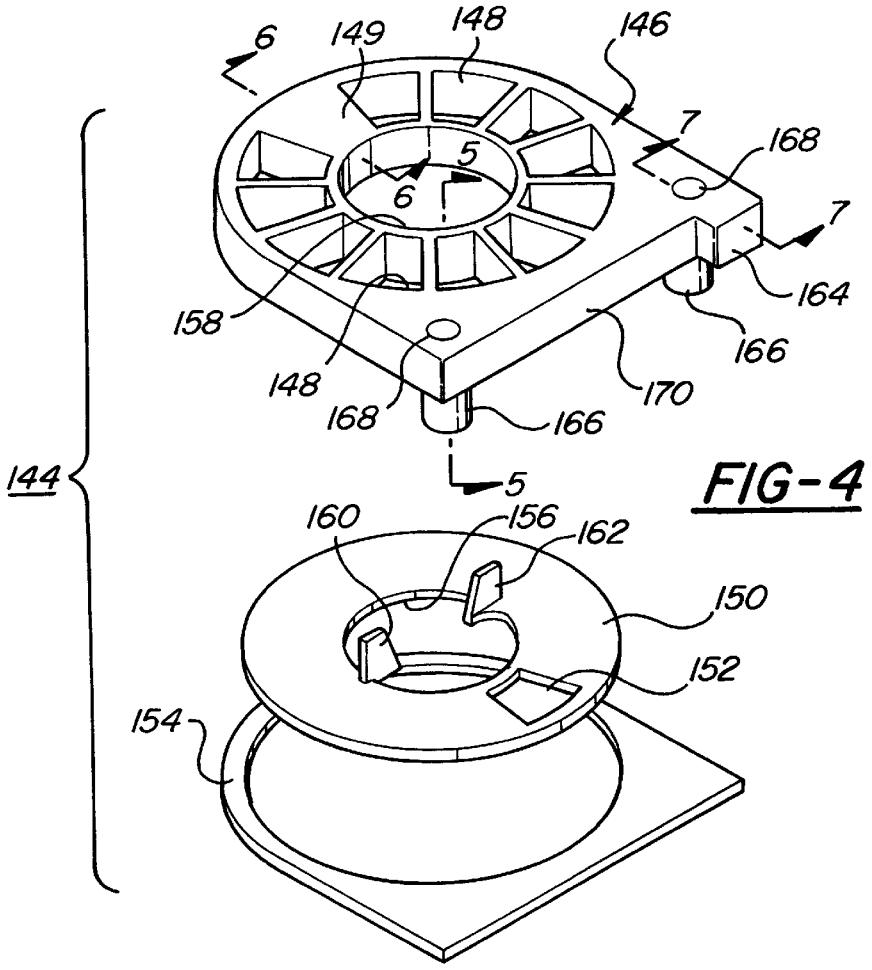
FIG. 4 is an exploded, perspective view of one of the modules of the article dispenser shown in FIG. 1.
Figure 6:
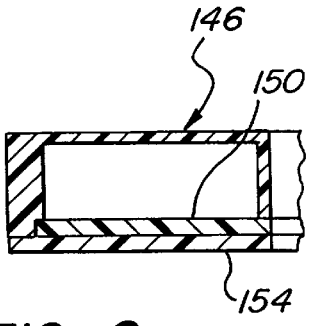
FIG. 6 is a cross-sectional view generally taken along line 6—6 in FIG. 4.
Figure 8:
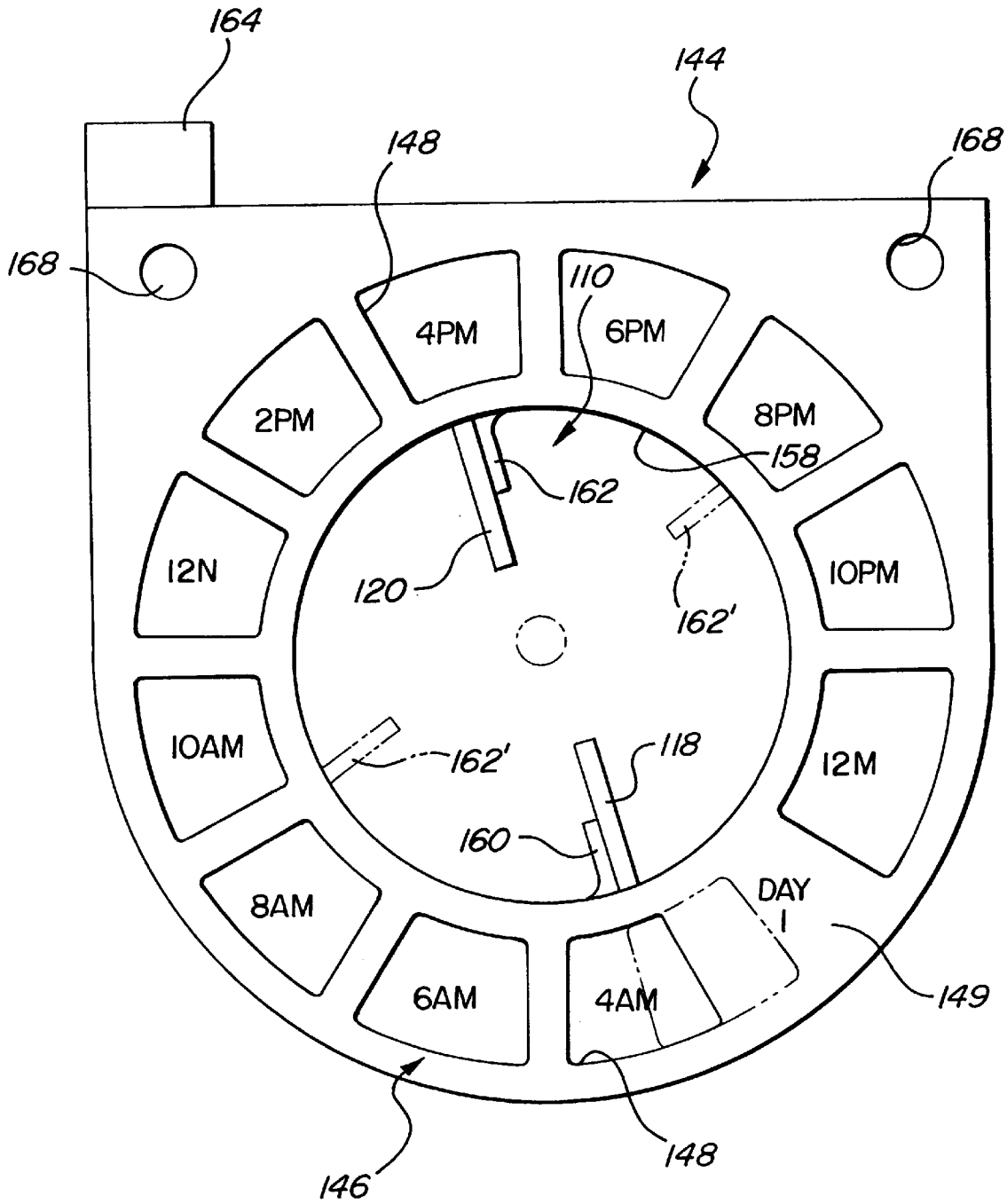
FIG. 8 is a plan view of one of the assembled modules shown in FIGS. 1 and 4.

Each of the modules 132, 134, 136, 138, 140, 142 and 144 is substantially identical such that the following description will be provided for only one of the modules, such as module 144 shown in FIG. 1, and in greater detail in FIGS. 4 and 8. The module 144 includes an article containing magazine 146 which has a plurality of circumferentially spaced, article storage compartments 148. A disk 150 is rotatably mounted in a circular recess below the magazine 146 and contains one aperture 152 which is successively alignable with the storage compartments 148 formed in the magazine 146. A retainer plate 154 having an enlarged central aperture 156 is fixedly secured to the bottom surface of the magazine 146 as shown in FIG. 6 and captures the rotatable disk 150 between itself and the bottom surface of the magazine 146.

Alternately, instead of the retainer plate 154, a plurality of clips may be used to rotatably mount each module 132–144 to a respective magazine 146.

In a preferred embodiment, each module, such as module 144, is configured for dispensing articles contained therein over a predetermined time period. In a typical example, each module, such as module 144, is designed to dispense articles throughout a 24-hour time period. Thus, the magazine 146 is provided with 11 circumferentially spaced storage compartments 148 and one blank or solid area 149. A blank or solid area 149 coincides with a 2:00 a.m. dispensing period, by example only, which is typically not used to dispense medicine. It will be understood that the number of individual storage compartments 148 may be varied as necessary depending upon the application of the article dispenser 10 of the present invention. That is, more or less storage compartments 148 may be provided in each magazine. Further, the number of modules in article dispenser 10 may also be varied to provide shorter or longer total article dispensing time periods.

As shown in detail in FIGS. 4–7, the magazine 146 is in the form of a planar body having a central, through aperture 158. The planar body is illustrated, by way of example only, as having a generally square rear end and an arcuate front portion. It will be understood that this is by way of example only as the body of the magazine 146 may have other shapes, such as completely circular, etc. The magazine 146 is preferably formed of a one-piece, molded plastic or assembled from individually molded or machined plastic components.

The storage compartments 148 are arranged in a circle about the central aperture 158 in the body of the magazine 146. Each of the storage compartments 148 is formed by a bore extending completely through the body of the magazine 146. Each compartment 148 has an open top end and an open bottom end. The shape of the storage compartments 148 is exemplary only as having a generally polygonal or substantially square configuration. Other shapes, such as circular, rectangular, etc., may also be employed.

The rotatable disk 150 has a generally thin, planar configuration. The disk 150 is preferably formed of a one-piece molded plastic body or constructed from separate plastic components which have been molded or machined to the desired shape and joined together by suitable means, such as adhesive, fasteners, heat welding, etc. A central aperture 156 in the disk 150 is co-axially aligned with the central aperture 158 in the magazine 146.

The single aperture 152 in the rotatable disk 150 extends completely through the disk 150 and has a shape complementary to the shape of the storage compartments 148 in the magazine 146. The aperture 152 is successively alignable with each of the storage compartments 148 in the magazine 146 as the disk 150 rotates about its center as described hereafter. Timing lug means in the form of lugs, tabs, fingers, etc., and denoted in general by reference number 160 and 162, are carried on the rotatable disk 150 and extend perpendicular of the plane of the disk 150 inward of the central aperture 156. The purpose of the timing lugs 160 and 162 will be described in greater detail hereafter.

Figure 7:
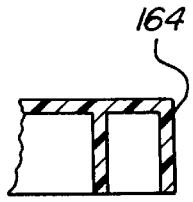
FIG. 7 is a cross-sectional view generally taken along 7—7 in FIG. 4.

A prescribed arrangement of the vertically stacked modules is provided in the article dispenser 10 by means of tabs which engage the stepped recesses 24 formed in the rear wall 22 of the outer shell 12, as shown in detail in FIG. 2. The body of the magazine 146 of the lowermost disposed module 144 is provided with an outwardly extending tab 164. The tab 164 is co-planar with the body of the magazine 146 and extends outward from the rear wall 22. The tab 164 has a prescribed length and shape as shown in FIGS. 2, 7 and 8 to fit into the lowermost recess 24. Similar tabs 164 are formed on the bodies of the magazines of each of the remaining modules 132, 134, 136, 138, 140, 142 and 144. Each of the tabs 164 has an increasing, different length and/or shape to specifically fit in one recess 24 when the modules are arranged in a vertical stack or column 130.

Figure 5:
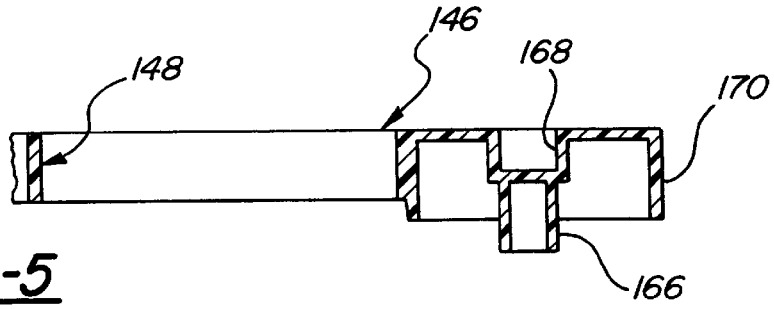
FIG. 5 is a cross-sectional view generally taken along line 5—5 in FIG. 4.

To further ensure proper alignment of each of the modules and, also, retention of each module in the outer shell 12 and cover 30, each module, such as module 144, along its rear edge 170, as shown in FIGS. 4 and 5, has a pair of downwardly projecting pegs 166 which are co-axially aligned with a pair of upwardly opening bores 168. One peg 166 is slidingly mountable into a bore 168 in a lowered disposed module. Likewise, a peg 166 from an upper disposed module is insertable into a bore 168 in the magazine 146 shown in FIG. 5 to securely inter-engage the modules into the vertical stack 130.

At least one and preferably a pair of bores 168 are also formed in the base 14 of the outer shell 12 to engage or receive the pegs 166 depending from the lowermost module 144. Likewise, the cover 30 is provided at least one and preferably a pair of depending pegs 166 which engage the bores 168 in the topmost module 132.

It will also be understood that the pegs 166 and the bores 168 in the base 14, the cover 30 and each module 132–144 could be staggered or offset with respect to each other to provide the same keyed effect as the recesses 24 and tabs 164 to enable the modules 132–144 to be vertically arranged in the stack 30 in only one possible arrangement.

Means are provided for successively and interconnectingly rotating the disks 150 in each of the modules in a timed, vertically successive relationship with respect to each other to successively align the apertures 152 in each disk 150 with successive storage compartments 148 in the associated magazine 146 to dispense articles from successive compartments 148 in each magazine 146 to corresponding compartments 148 in an adjacent, lower disposed magazine 146 in the vertical stack 130 of magazines from the top to the bottom of the stack 130 whereby the articles are dispensed from the lowermost magazine 132 to the discharge chute 74.

In a preferred embodiment, the rotating means comprises the synchronous, preferably unidirectional, electric motor 114 and the timing dial 110. The electric motor 114 is connected to a source of electric power, such as by 12 VAC power through a cord and/or switch from a wall outlet mountable 120 VAC/12 VAC step down transformer, to activate the motor 114 when desired. Further, suitable gearing may be provided between the motor 114 and the output shaft 112 to provide any desired rotational speed of the output shaft 112. In the described example, the motor 114 is selected or geared to provide one complete rotation of the output shaft 112 and the attached timing dial 110 over a single 24-hour time period. Obviously, the gearing can be modified to provide different periods of rotation as desired for a particular application of the article dispenser 10.

Figure 11:
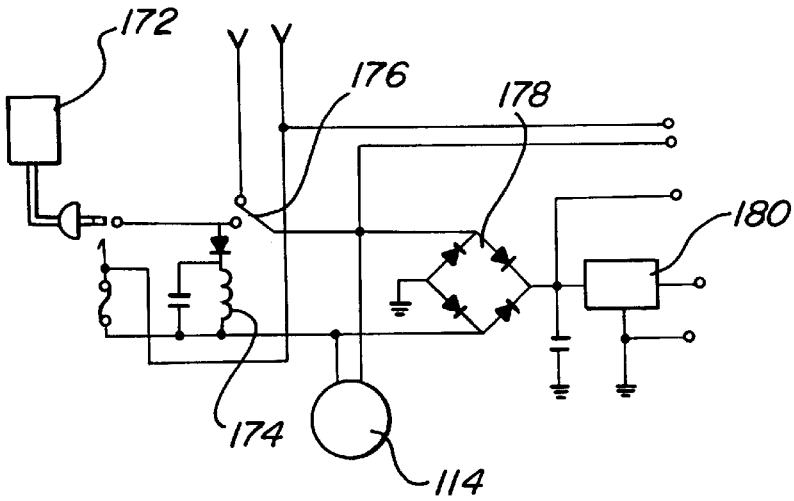
FIG. 11 is a schematic diagram of the power supply used in the article dispenser of the present invention.

As shown in FIG. 11, 12 VAC power from the transformer 172 is supplied to the motor 114 and to a relay 174. The normally closed, switchable contact 176 of the relay 174 is interconnected between a power conductor connected to a backup power source and the 12 VAC power output from the transformer 172. When the relay 174 is activated by the application of 12 VAC power from the transformer 172, the relay coil causes the contact 176 to switch positions to connect power from the transformer 172 to a rectifier bridge 178 which rectifies the 12 VAC power into +16 VDC power. A voltage regulator 180 converts the 16 VDC power to a 12 VDC power at one terminal.

The use of the timing lug means 160, 162 to stagger the rotation of the disks 150 in each of the modules 132–144 will now be described with reference to FIG. 8 which shows the position of the lugs 160 and 162 on the disk 150 on the lowestmost modules 144 and the lugs 160 and 162 on the next upper module 142. The disk 150 in the uppermost module 144 does not require any lugs 160 and 162.

As shown in FIG. 8, the angular position of the lugs 160 and 162 about the central aperture 156 in each of the disk 150 is angularly staggered or offset for each module in the module stack 130. Thus, the lugs 160 and 162 on the disk 150 in the module 144 are angularly spaced from the lugs 160 and 162 on the next upper disk 150 in the module 142. In this manner, the lowermost disk 150 must initially rotate a predetermined angular amount, such as to move the aperture 152 in the disk 150 from alignment with one storage compartment. 148 or the blank area 149 to a third spaced storage compartment 148. When the lugs 160 and 162 rotate the prescribed angular increment, the lugs 160 and 162 engage the lugs 160 and 162 on the next uppermost disk 150 in module 142 so as to initiate simultaneous rotation of the disks 150 in the lowermost two modules 144 and 142. The upward extending lugs 160 and 162 on the disk 150 of the module 142 must also rotate a predetermined angular amount, such as from one storage compartment 148 to the third spaced storage compartment 148 before the upwardly extending lugs 160 and 162 engage the lugs 160 and 162 of the disk 150 in the next uppermost module 140. When the lugs 160 and 162 engage, each of the disks 150 in the lowermost three modules 144, 142, and 140 are engaged for simultaneous rotation by the drive motor 114. The same angular offset is provided in the remaining disks 150. This is achieved by providing disks 150 for each module in which the lugs are angularly spaced from disk 150 to disk 150.

In this manner, the initial movement of each of the disks 150 in the modules is staggered in a time delayed relationship so as to offset rotation of the apertures 152 in the disks 150. This causes articles contained in each module to pass from an upper disposed module to the next lowermost module, such as from module 140 to module 142, as articles are dispensed from the module 142 to the next lower module 144. The articles thus pass only through one module at a time and not through the complete vertical stack 130 of modules. This minimizes any potential breakage of fragile articles which may be dispensed by the article dispenser of the present invention.

As shown in the circuit of FIG. 12, and as partly described above, a photo receiver 182 and light source 184 are mounted on the flanges 124 and 126 on the base 14 of the outer shell 12. As shown in FIG. 10A, due to the length of the arcuate flanges 122 projecting from the bottom surface of the timing dial 110, the light beam between the light source 184 and the photo receiver 182 will normally be blocked except for the brief period of time each gap between adjacent flanges 122 lines up with the light path between the light source 184 and the receiver 182. When the light beam is completed between the light source 184 and the receiver 182, as shown for the photo interrupter module 186 containing the light source 184 and photo receiver 182, the module 186 generates a square wave output which amplifier 188 amplifies to a single amplified square wave output. The high going output from the amplifier 188 biases the gate of transistor 190 to drive the transistor 190 into conduction and supplying an activating signal to a triac driver 192 which connects 12 VAC power to the second motor 90 for the duration of the output pulse from the amplifier 188. The motor 90 has a higher revolution speed than the first motor 114, such as 3 rpm by example only. This enables the paddle assembly 94 fixedly attached to the output shaft 92 of the motor 90 to rotate at a fast revolution about the track 70 of the inner shell 60 and sweep any articles deposited from the lowermost module 144 along the track 70 to the discontinuity 72. These articles then fall in the interior holding chamber 86 below the discontinuity 72 and the track 70 as shown in FIG. 10A. At the same time, the aperture 97 in the paddle assembly 94, which follows the blocker arm 99 in the counter-clockwise rotation of the paddle assembly 94 causes any articles remaining in the interior chamber 86 from the previous article dispensing cycle which were not retrieved by the user to slide down the inclined chute 102 in the inner shell 60 to the storage container 50.

One or more of the light emitting diode 104 and photo receiver or photo transistor 106, as described above, is mounted in line the bottom of the V-shaped interior of the storage container 50. When the light beam from the LED 104 to the photo transistor 106 is interrupted by articles deposited into the storage compartment 50, the photo transistor 106 is gated off which causes an amplifier 194 to generate an output pulse to the base of transistor 196 which activates an alarm or indicator 198, such as an LED light source. The output of the amplifier 194 is also connected to a pin connector 200 which provides output signals to external devices, such as a telephone with auto dial capabilities to enable a remote party to receive an indication that dispensed articles have not been removed from the article dispenser 10 by the user. This is particularly important in the case where the dispensed articles are pills or medications which must be taken at a prescribed timed interval by a user. Failure to take such articles at the proper time can decrease the medicinal effect of such pills or medications or lead to potentially disastrous health consequences for the user.

At the same time, the deposit of non-dispensed articles to the storage container 50 ensures that such articles cannot be used by the user. Again, in the case of pills or medications, this prevents a user from taking a double dose of a medication.

Figure 13:
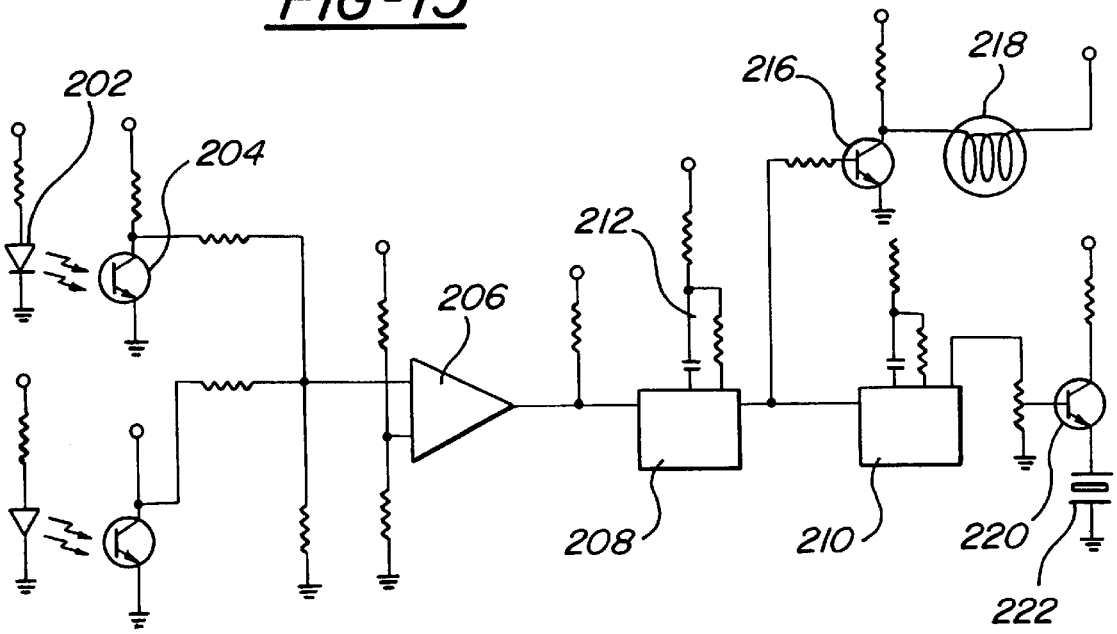
FIG. 13 is a schematic diagram of the dispensing chute detector and indicator circuit.
Figure 14:
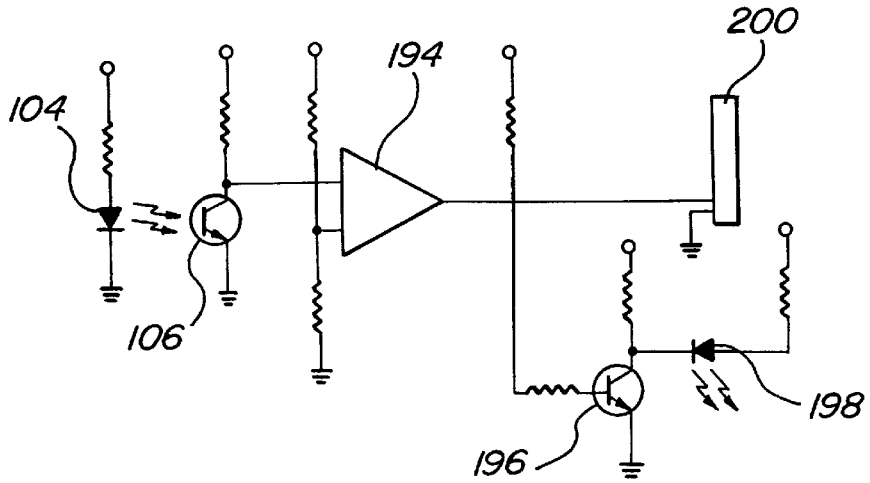
FIG. 14 is schematic diagram of the storage area article detector and alarm circuit.

As shown in FIG. 13, at least one LED light source 202 and photo receiver or photo transistor 204 may be mounted at the bottom of the interior chamber 86 below the upper track 70 of the inner shell 60. When articles are deposited in the bottom of the interior chamber 86, as described above, the articles interrupt the light beam from the light source 202 and the photo transistor 204 causing amplifier 206 to generate an output pulse to series connected clocks 208 and 210. RC circuits 212 and 214 respectively connected to the clocks 208 and 210 maintain the clock outputs for a time period established by the respective RC circuit 212 or 214. The output of the first clock 208 is input to a transistor 216 which drives a visual dispense indicator or lamp 218. The lamp 218, as shown in FIG. 10, is located behind the transparent or translucent cover plate 43 on the front wall 16 of the outer shell 12. The lamp 218 will flash at the clock rate of the clock 208 for the time established by the RC circuit 212. The output signal of the clock 208 can also activate a person carried vibrator or beeper to provide a remote signal of a dispense event.

Similarly, the second clock 210 provides an output pulse series to transistor 220 which drives an audio indicator, such as a piezo transducer 222, which generates an audible sound pulsing on and off at the rate of the output of the clock 210 for the time period established by the RC circuit 214.

The time periods established by RC circuits 212 and 214 are chosen with regard to the particular articles to be dispensed by the article dispenser 10. These time periods can be approximately five minutes to twenty minutes in the case of pills or medications so as to require a user to remove the pills or medications from the dispenser 10 on the prescribed time basis. The indicators 218, etc., will be deactivated after the door 82 is locked.

In use, the modules can be placed side-by-side with the lowermost module 144 labeled "day 1", and succeeding modules 142, 140, etc., labeled "day 2", day 3", etc. Labeling each module as a consecutive day number in a weekly dispensing period enables the dispenser apparatus 10 to be started on any day of the week rather than on a specific day, such as Monday, etc. However, for ease of use, a removable label carrying one day of the week indicia, such as Monday, Tuesday, etc., can be attached to the appropriate module. The disks 150 in each module are then rotated until the aperture 156 is disposed beneath the solid area or portion 149 of each magazine 146 and the modules stacked to form the stack 130.

For ease of use, each disk 150 may have time labels disposed thereon coinciding with each of the storage compartments 148. Such labels can be a simple indication of 4:00 a.m., 6:00 a.m., etc., up to 12:00 midnight arranged circumferentially in a clockwise manner starting with the portion which will initially underlie the first storage compartment 48 disposed clockwise from the solid area 149 when one module is viewed from above with the rear wall toward the top.

In this arrangement, the tabs 160 and 162 on each disk 150 will extend upward through the aligned central apertures 156 in each of the disks 150 and through the co-axial apertures 158 in the corresponding module magazine 146 such that the upper ends of the tabs 160 and 162 in a lower module will lie in an intersecting path with the bottom portion of the tabs 160 and 162 of an immediately higher or upper module.

Further, although each of the disks 150 are identically formed, an offset is formed in each disk 150 for the seven modules so as to circumferentially space the lugs 160 and 162 of an immediately higher module from the corresponding lugs 160 and 162 in the immediately lower module. This circumferential spacing may be equivalent to one, two or three or even more storage compartments 148. By example only, the offset or spacing is essentially three storage compartments wide in the present example of the article dispenser 10.

The person responsible for filling the dispenser modules with articles, with pills being used only as an example of the articles, then places the specific pills and the required number of pills in the appropriate individual storage compartments according to the time and each day the pills are to be dispensed. The modules are then stacked in the vertical column or stack 130 one at a time in the outer shell 12. The tabs 164 projecting rearwardly of each module fit into the mating steps 24 in the rear wall 22 of the outer shell 12 to ensure that the modules are stacked in the required order. For example, the required order places the module 144, labeled "day 1" lowermost on the outer shell 12. The module 142, labeled "day 2" is disposed immediately above the module 144. The remaining modules are arranged in consecutive day order as shown in FIG. 1.

In initiating operation, the motor 114 is energized and the timer dial 110 set to the current time. The stack 130 is then placed on the base 14. As shown in FIG. 15, the top surface of the one of the lugs 118 or 120 is provided with an arrow 119, either as a printed indicia or molded directly on the top surface of the lug 118 or 120. The arrow 119 points outward to a plurality of time indicia printed or otherwise formed on the base 14 of the outer shell 12. In the present example of twelve timing periods, twelve timing indicia, such as 12 midnight, 2:00 am, 4:00 am, etc., are circumferentially spaced about the periphery of the timer dial 110 on the base 14. The cover 30 is then closed and automatically locked to the outer shell 12.

When electric power is supplied to the article dispenser 10, the motor 114 rotates the output shaft 112 and the attached timer dial 110. The tabs 118 and 120 on the timer dial 110 engage the lugs 160 and 162 on the rotatable disk 150 in the lowermost module 144. The continued operation of the energization of motor 114 causes the tabs 118 and 120 and the engaged lugs 160 and 162 to continue to rotate in a clockwise direction. Such clockwise rotation of the rotatable disk 150 rotates the aperture 152 in the disk 150 in a clockwise direction underneath each successive storage compartment 148 in the module 144. Any pills or articles contained in the first clockwise disposed storage compartment 148 from the solid or blank area 149 will be dispensed through the aperture 152 in the disk 150 as the aperture 152 moves under the first storage compartment 148 spaced clockwise from the blank or solid area 149.

As the articles or pills which are typically small in the case of pills, can lie anywhere within the storage compartment 148 and, further, since the aperture 152 in the disk 150 gradually has its forward edge moving completely across the storage compartment 148 over a two hour period, the articles or pills can be dispensed from the first storage compartment 148 onto the track 70 on the inner shell 60 at anytime throughout the two hour period. Further, as noted above, at the end of each two hour period or cycle, the flanges 122 on the bottom of the timer dial 110 will also have rotated until the gap between two adjacent flanges 122 is aligned with the light beam in the photo cell pair 186. This generates an output signal which activates the first motor 90 to rotate the paddle assembly 94 one revolution about the track 70. During such rotation, the arms 98 on the paddle assembly 94 sweep any articles, such as pills, deposited from the storage compartment 148 in the lowermost module 144 along the track 70 and into the discontinuity 72 wherein the articles or pills fall into the interior chamber 86 beneath track 72. The presence of such articles in the chamber 86 is sensed by the photo detector pair 202, 204 which generates an indication by activating the lamp 218 and audio buzzer 222. The user then can rotate the flap 84 which also pivots the door 82 and allows the articles to fall from the interior holding chamber 86 along and to the bottom of the discharge chute 74 for removal by the user.

Proceeding with the operation of the dispenser 10, continued rotation of the motor 114 will eventually cause the lugs 160 and 162 on the disk 150 of the lower most module 144 to rotate sufficiently to engage the corresponding lugs 160 and 162 on the next upper module 142 thereby starting simultaneous rotation of the disk 150 of the module 142 with rotation of the disk 150 in the module 144. The aperture 152 in the disk 150 in the module 142 then successively moves underneath each of the storage compartments 148 in the module 142 allowing any articles or pills contained in such storage compartments 148 to fall to aligned storage compartment 148 in the module 144. These articles will be dispensed in the same manner as described above and at the set time upon continued rotation of the disk 150 in the lowermost module 144.

The same sequence of operation occurs for each of the next upper succeeding modules. Such articles fall only from one module to the next lowermost module upon each 360° rotation of the associated rotatable disk 150. Such articles thus gradually drop module by module through the stack 130 until the articles reach the lowermost module 144 wherein they are dispensed as described above into the discharge chute 74.

In summary, there has been disclosed a unique article dispenser which provides an automatic time dispensing of articles at prescribed intervals over a total time period. The article dispenser is easy to use and to reload with additional articles. Further, the staggered transfer of articles from each module in the article dispenser to the next adjacent, lower module, minimizes potential breakage or damage to such articles.

What is claimed is:

1. An article dispenser apparatus for dispensing a plurality of articles on a timed basis comprising:

a plurality of modules vertically stacked in a co-axial column, each module including:

an article container magazine having a plurality of article storage compartments, each storage compartment having an open top, an open bottom an a through bore extending therethrough;

a disk rotatably mounted to each magazine, the disk having an aperture successively alignable with each storage compartment in the magazine upon rotation of the disk;

means for rotating the disks in the plurality of modules in a timed relationship with respect to each other to successively align the apertures in each disk with successive storage compartments in the magazine associated with each disk to dispense articles from an upper storage magazine to a lower adjoining storage magazine interrupting vertical movement of dispensed articles at each magazine level while dispensing said articles from the top to the bottom of the column of modules;

a discharge chute disposed below the lowermost module; and means for successively dispensing articles from the lowermost magazine to the discharge chute.

2. The article dispenser apparatus of claim 1 wherein the rotating means comprises:

a first drive means;

means for coupling the first drive means to the disk in the lowermost module; and at least one timing lug mounted on each disk at predetermined angular positions and engagable with the timing lug of adjacent disks to cause a staggered, time-delayed advance and vertical offset of the apertures in each of the disks as the drive means rotates the disk in the lowermost module and the timing lugs on the disks in progressively engage.

3. The article dispenser apparatus of claim 2 wherein the drive means comprises an electric motor.

4. The article dispenser apparatus of claim 2 wherein the coupling means provides unidirectional rotation of the disks.

5. The article dispenser apparatus of claim 1 further including:

a central aperture formed in each disk and each magazine of each module; and the timing lug on each disk in each module extending through the respectively aligned central apertures for engaging the timing lug of an upper adjacent module.

6. The article dispenser apparatus of claim 1 wherein the successively dispensing means comprises:

an annular track disposed beneath the lowermost module in the column of modules;

a discontinuity formed in the track;

a paddle rotatably disposed with respect to the track for sweeping articles disposed on the track from the lowermost module along the track; and second drive means for rotating the paddle.

7. The article dispenser apparatus of claim 6 wherein the second drive means comprises an electric motor.

8. The article dispenser apparatus of claim 6 further including:

means for activating the second drive means once for every predetermined amount of angular incremental rotation of one of the first drive means and the disk in the lowermost module.

9. The article dispenser apparatus of claim 8 wherein the activating means comprises:

an annular member mounted on and rotatable with an output shaft of the second drive means;

indications carried on the annular member; and a detector for detecting the passage of each indicator during rotation of the annular member, the detector generating an output signal upon each detection, the output signal activating the second drive means.

10. The article dispenser apparatus of claim 6 further comprising:

a door controlling access to an inlet of the discharge chute; and a flap carried with the door and user engagable to move the door from a first position in which the door closes access to the inlet of the discharge chute and a second position in which the door is spaced from the inlet of the discharge chute, the door forming part of an interior holding chamber communicating with the discontinuity in the track for receiving articles from the track.

11. The article dispenser apparatus of claim 10 further comprising:

an aperture carried by the paddle and allowing articles disposed within the interior chamber to be removed from the interior chamber at predetermined time intervals.

12. The article dispenser apparatus of claim 11 wherein the article removing means further comprises:

a non-retrieved article storage container disposed in communication with the interior chamber for receiving non-retrieved articles from the interior chamber.

13. The article dispenser apparatus of claim 12 wherein the non-retrieved article storage container is removably mountable in the article dispenser.

14. The article dispenser apparatus of claim 12 further comprising:

a sensor, for sensing articles within the storage container, the sensor generating an output upon detecting the presence of articles; and an indicator, responsive to the output of the sensor, for providing an indication of articles within the storage container.

15. The article dispenser apparatus of claim 10 further including:

a sensor for sensing the presence of articles in the interior holding chamber, the sensor generating an output when articles are detected.

16. The article dispenser apparatus of claim 15 further comprising:

an indicator, responsive to the output of the sensor, for providing an indication that articles are disposed in the interior chamber.

17. The article dispenser apparatus of claim 16 further comprising:

a timer, responsive to the output of the sensor, for deactivating the indicator after a preset time period.

18. The article dispensing apparatus of claim 1 further including:

a discrete projection extending outward from each magazine;

the projections in the magazines of all of the modular modules having a keyed shape to permit one exclusive vertical arrangement of the modules when the modules are arranged in a stack.

19. The article dispenser apparatus of claim 18 further including:

an outer shell having sidewalls and a rear wall;

discrete cavities formed in the rear wall of the outer shell and matingly receiving the projections on the modules only when the modules are arranged in a predetermined vertical order.

20. The article dispenser apparatus of claim 19 further comprising:

a lid removably latchable to the outer shell, the lid cooperating with the sidewall and the rear wall to retain the modules within the outer shell.

21. The article dispenser apparatus of claim 10 further comprising:

means for locking the door at predetermined intervals from movement to a position allowing dispensing of articles to the discharge chute.

22. The article dispenser apparatus of claim 21 wherein the locking means comprises:

a plurality of circumferentially spaced lock arms carried on the rotating means, the lock arms having a distal end disposed in proximity with the door to prevent movement of the door from the first position to the second position when one of the lock arms is disposed adjacent to the door.

* * * * *